US006202333B1

(12) United States Patent
Grate et al.

(10) Patent No.: US 6,202,333 B1
(45) Date of Patent: Mar. 20, 2001

(54) CHANNEL LETTERS

(76) Inventors: Anton Grate, 38 Coventry Chase, Joliet, IL (US) 60431; Cherly Grate, 708 Cambridge La., Shorewood, IL (US) 60435

( * ) Notice: Subject to any disclaimer, the term of this patent is extended or adjusted under 35 U.S.C. 154(b) by 0 days.

(21) Appl. No.: 09/241,644

(22) Filed: Feb. 1, 1999

(51) Int. Cl.[7] ..... G09F 13/00
(52) U.S. Cl. ..... 40/575; 40/552
(58) Field of Search ..... 40/552, 564, 575, 40/645, 716

(56) References Cited

U.S. PATENT DOCUMENTS 1,697,501 * 1/1929 Gast ..... 40/552
2,902,787 * 9/1959 Cook ..... 40/716
4,796,170 * 1/1989 Pederson et al. ..... 40/564 X

FOREIGN PATENT DOCUMENTS

2729777 * 1/1979 (DE) ..... 40/552
1091509 * 4/1955 (FR) ..... 40/552

* cited by examiner

*Primary Examiner*—Cassandra Davis
(74) *Attorney, Agent, or Firm*—Robert L. Marsh

(57) ABSTRACT

A channel letter has a rear surface for mounting against a raceway, wall, or a structure for supporting the signage, and sides defining the figuration of the letter or shape to be depicted. A lighting element is positioned against the rear surface of the enclosure. To retain the lens to the open front of the enclosure, a shoulder is provided along the inner surface of the sides thereof where the shoulder defines a plane parallel to the outer ends of the sides but is recessed therefrom. A planar transparent lens having an outer edge which is in the shape of the letter and sized to fit within the sides of the enclosure is retained against the shoulder by a suitable retaining means such as screws.

8 Claims, 2 Drawing Sheets

CHANNEL LETTERS

The present invention relates to channel letters of the type used to create signage, and in particular to an improved method of manufacturing a channel letter.

BACKGROUND OF THE INVENTION

Channel letters are used to provide signage for buildings, shopping malls, and the like where it is desirable that the signage comprise illuminated letters or any other shapes that are easily seen, even a great distance, even at night. Each channel letter consists of an enclosure, usually a metal box, having a rear surface which is positioned against a raceway, the wall of the building or the like, on which the signage is mounted and a plurality of sides which define the figuration of the letter or shape. A light source, such as a neon tube or other light source is positioned within the walls of the enclosure and attached to the rear surface to provide illumination for the letter.

The channel letter also includes a planar, transparent lens, the outer shape of which corresponds to the figuration of the letter or any other shape as defined by the sides of the enclosure. The lens has a trim cap glued to the outer edges thereof which form a border to the lens and create a lip sized to fit snugly around the forward ends of the sides of the enclosure for retaining the lens to the enclosure. Screws are threaded through the lips of the trim cap and into the sides to retain the lens across the forward opening of the enclosure.

The manufacture of channel letters requires that a metal box be made having a back and sides with the sides defining the figuration of the letter or shape. The manufacture of the lens requires that a planar panel of transparent plastic be cut to the shape of the enclosure and that the trim cap be glued to the outer edges of the lens. The process of gluing the trim cap around the edges of the lens, however, is labor intensive and it is, therefore, expensive to manufacture the lens which fits across the forward ends of the enclosure of a channel letter.

It would be desirable to provide a channel letter having a lens which could be manufactured without incurring the labor intensive step of requiring the attachment of a trim cap.

SUMMARY OF THE INVENTION

Briefly, the present invention is embodied in a channel letter. For the purposes of this description, a channel letter is defined as including a letter of the alphabet, a numeral, an element of punctuation such as a comma, an exclamation point, or any other shape or form.

The channel letter of the present invention has a rear surface for mounting against a raceway, wall, or a structure for supporting the signage, and sides defining the figuration of the letter or shape to be depicted. A lighting element, such as a neon tube or any other light source is positioned against the rear surface of the enclosure and defines the shape of the letter to provide illumination therefore.

To retain the lens to the open front of the enclosure, a shoulder is provided along the inner surface of the sides thereof where the shoulder defines a plane parallel to the outer ends of the sides but is recessed therefrom. A planar transparent lens having an outer edge which is in the shape of the letter and sized to fit within the sides of the enclosure is retained against the shoulder by a suitable retaining means such as screws or the like.

DETAILED DESCRIPTION OF DRAWINGS

A better and more complete understanding of the present invention will be had after a reading of the following detailed description taken in conjunction with the drawings herein:

DETAILED DESCRIPTION OF THE PREFERRED EMBODIMENT

Figure 1:
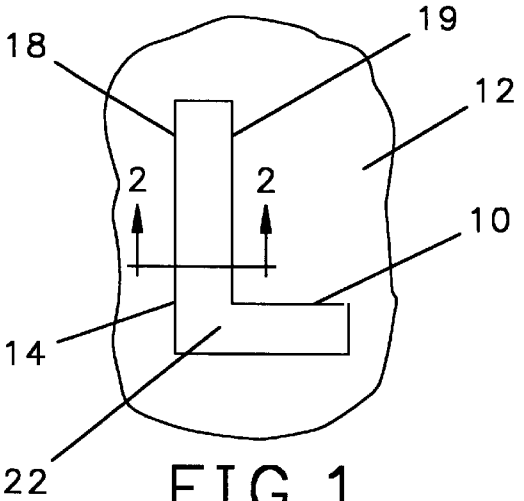
FIG. 1 PRIOR ART
FIG. 1 is a front elevational view of a prior art channel letter.
Figure 2:
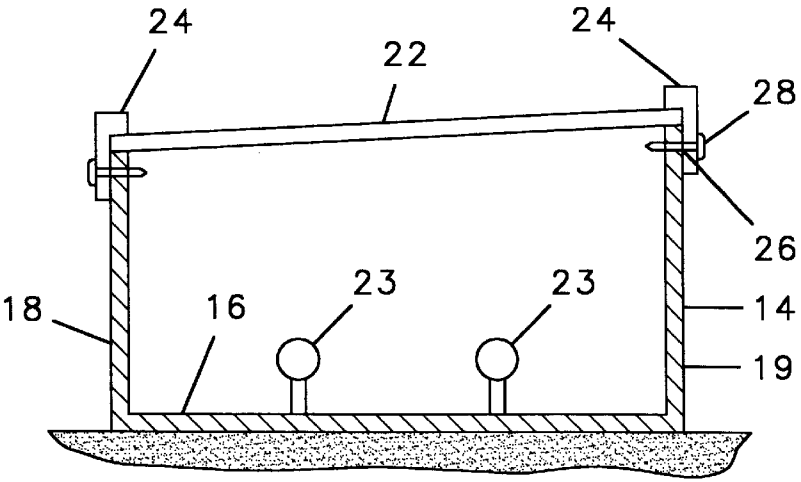
FIG. 2 PRIOR ART
FIG. 2 is an enlarged cross sectional view taken through line 2—2 of FIG. 1.
Figure 3:
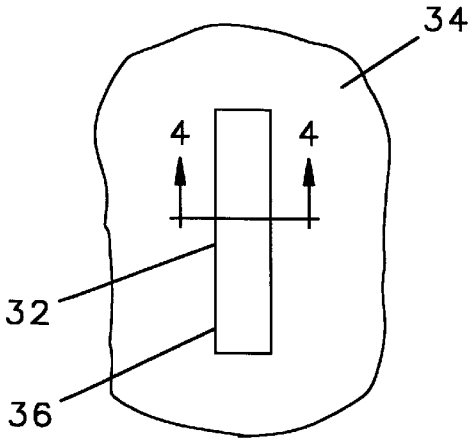
FIG. 3 is a front elevational view of a channel letter in accordance with the present invention.
Figure 4:
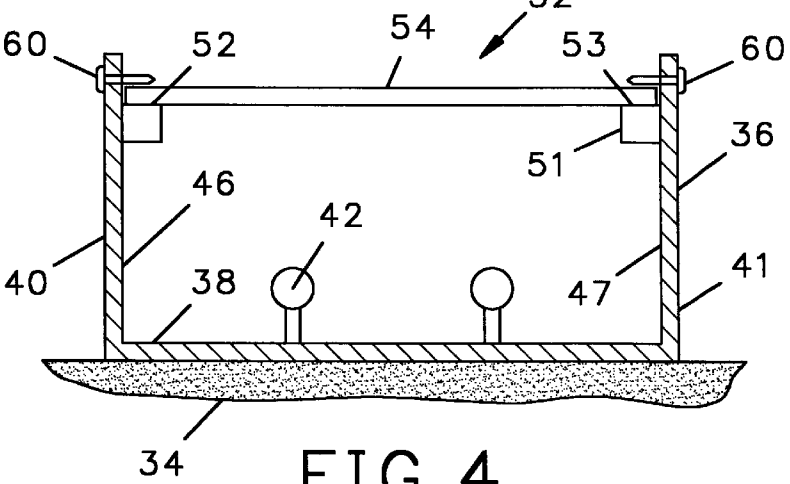
FIG. 4 is an enlarged cross sectional view of the channel letter in FIG. 3 taken through line 4—4 thereof.
Figure 5:
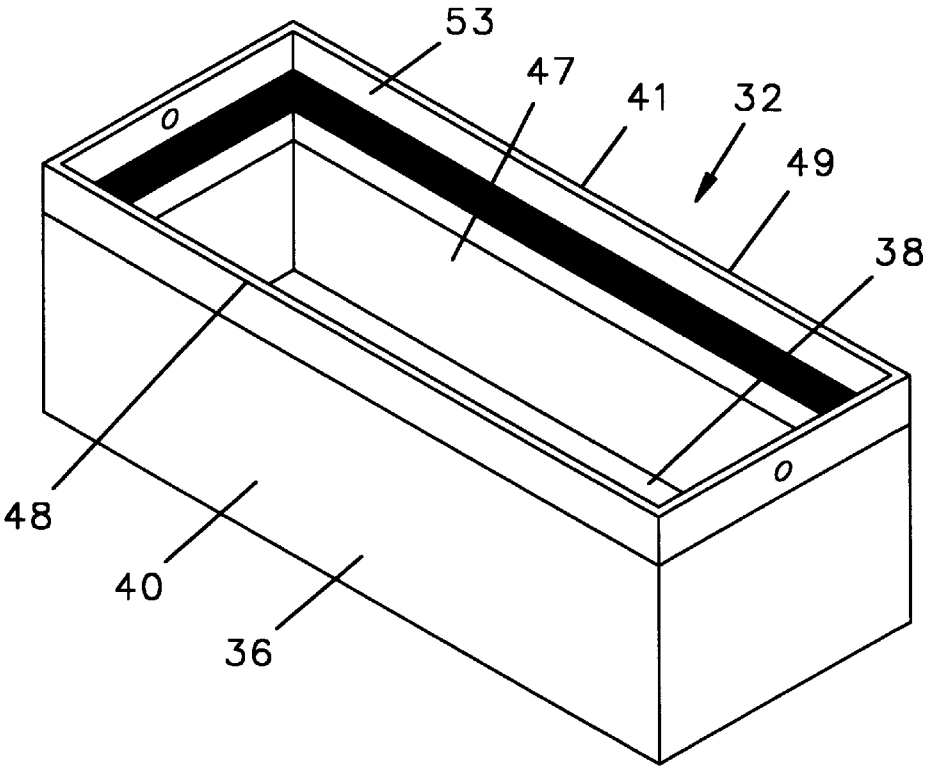
FIG. 5 is a fragmentary isometric view of a portion of the enclosure as of the channel letter in FIG. 3.
Figure 6:
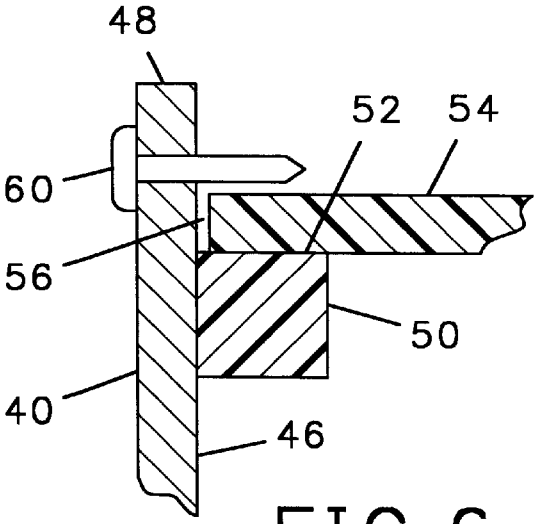
FIG. 6 is a fragmentary enlarged cross sectional view of the mounting of the lens in the channel letter shown in FIG. 3.

Referring to FIGS. 1 and 2, a channel letter 10 is mounted on a supporting structure 12. As shown, the channel letter 10 includes a metal enclosure member 14 having a rear surface 16 and a plurality of side walls 18, 19 which are contoured to define the edges of a letter 10. The forward edges of the sidewalls 18, 19 define a plane and fitted across the forward edges is a transparent lens 22 having a shape corresponding to that defined by the walls 18, 19 of the enclosure member 14.

Retained to the rear surface 16 of the enclosure member 14 is a light source 23 which extends through the length of the channel letter 10 and illuminates the entire surface of the lens 22.

Referring further to FIG. 2, in accordance with the prior art, the lens 22 is retained to the side walls 18, 19 of the enclosure member 14 by trim cap 24, a plastic border member which is glued to the outer edges of the lens 22. The trim cap 22 has a rearwardly extending lip 26 that fits over the forward edges of the side walls 18, 19 and the trim cap 24 and lens 22 are retained to the enclosure member 14 by plurality of screws 28.

The manufacture of a channel letter 10 in accordance with the prior art requires the construction of the enclosure member 14, the manufacture of a light fixture 23 and of the lens 22. Manufacture of the lens 22 requires cutting a transparent plastic material into the shape of the channel letter 10 and attaching the trim cap 24 around the edges thereof. The gluing of the trim cap 24 to the edges of the lens 22, however, must be carefully undertaken and is a time consuming, labor intensive process which adds significantly to the cost of the channel letter 10. It would therefore be desirable to provide a less expensive method of attaching a lens 22 to the channel letter 10.

Referring to FIGS. 3, 4, and 5 and 6, a channel letter 32 in accordance with the present invention is attached to a supporting structure 34 and includes a metal enclosure member 36 having a rear surface 38 and a plurality of side walls 40, 41. Fitted within the enclosure member 36 is a light source 42, all in accordance with the prior art.

In accordance with the present invention, extending around the inner surface 46, 47 of the side walls 40, 41 and spaced a short distance from the forward edges 48, 49 thereof are shoulders 50, 51 and the forward surfaces 52, 53 of the shoulders define a plane. It should be appreciated that the least expensive method should be employed to provide the shoulders 50, 51 along the inner surfaces 46, 47. Rubber stripping, foam stripping or any other suitable flexible material that can be easily glued to the inner surface of the side walls 40, 41 can be used as shown to form the shoulder 50 of the present invention.

The lens 54 for the channel letter 32 is cut from a planar panel of transparent plastic with the outer edges 56 thereof having dimensions small enough to fit within the side walls 40, 41 of the letter 32 and against the forward surfaces 52, 53 of the shoulders and is held in place by the plurality of screws 60 to retain the lens 54. To service the interior of the channel letter 32, a technician would remove the retaining screws 60 from the side walls 40, 41 after which the lens 54 can be removed.

A channel letter in accordance with the present invention is less expensive to manufacture than the prior art letter 10 and yet it provides the same attractive appearance.

While a single embodiment of the present invention has been disclosed, it will be appreciated that many modifications or variations may be made without departing from the true spirit and scope of the invention. It is therefore the intent of the pending claim to cover all such variations and modifications which fall within the true spirit and scope of the invention.

What is claimed is:

1. A channel letter comprising an enclosure member having sides defining the figuration of said letter and having an open front and a rear surface, said sides having a rearward end against said rear surface, a forward end, an outer surface, and an inner surface viewed in cross, said inner surface of said sides extending linearly without interruption from said rearward end to said forward end, a light element within said enclosure member, a shoulder on at least one of said uninterrupted inner surfaces of said sides, said shoulder on said at least one of said uninterrupted inner surfaces defining a plane, said shoulder formed solely by a strip of flexible material having a continuous rectangular cross-section secured to said at least one of said uninterrupted inner surfaces of said sides, said shoulder spaced from said forward ends of said sides, a planar transparent lens having an outer edge in said shape of said letter and sized to fit within said sides of said enclosure and against at least a portion of said shoulder, and retaining means for retaining said lens within said enclosure and against said shoulder.

2. A channel letter in accordance with 1 wherein said retaining means is a mechanical fastener.

3. A channel letter in accordance with claim 1 wherein said retaining means comprises a plurality of elongate members, each elongate member extending through said inner surface and said outer surface of one of said sides and across a portion of said lens.

4. A channel letter in accordance with claim 1 wherein said strip of flexible material is rubber.

5. A channel letter in accordance with claim 1 wherein said strip of flexible material is foam.

6. A channel letter comprising an enclosure member having sides defining the figuration of said letter and having an open front and a rear surface, said sides having a rearward end against said rear surface, a forward end, and an inner surface viewed in cross, said inner surface of said sides extending linearly without interruptions from said rearward end to said forward end, a light element within said enclosure member, a shoulder on at least one of said uninterrupted inner surfaces of said sides, said shoulder on said one of said uninterrupted inner surfaces defining a plane, said shoulder formed solely by a strip of flexible material having a continuous cross-section secured to said at least one of said uninterrupted inner surfaces of said sides, said shoulder spaced from said forward ends of said sides, a planar transparent lens having an outer edge in said shape of said letter and sized to fit within said sides of said enclosure and against at least a portion of said shoulder, and retaining means for retaining said lens within said enclosure and against said shoulder.

7. A channel letter in accordance with claim 6 wherein said strip of flexible material is rubber.

8. A channel letter in accordance with claim 6 wherein said strip of flexible material is foam.

* * * * *

UNITED STATES PATENT AND TRADEMARK OFFICE

CERTIFICATE OF CORRECTION

PATENT NO. : 6,202,333 B1
DATED : March 20, 2001
INVENTOR(S) : Anton Grate and Cheryl Grate It is certified that error appears in the above-identified patent and that said Letters Patent is hereby corrected as shown below:

Column 3,
Line 27, after "surface" insert -- , --.
Line 28, after "in" delete "cross" and substitute -- cross-section --.

Column 4,
Line 19, after "in" delete "cross" and substitute -- cross-section --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*